US011435072B1

(12) United States Patent
Shott et al.

(10) Patent No.: US 11,435,072 B1
(45) Date of Patent: Sep. 6, 2022

(54) ADJUSTABLE-LENGTH CEILING-MOUNTED CANOPY FOR A LIGHTING FIXTURE

(71) Applicant: Hammerton, Inc., Salt Lake City, UT (US)

(72) Inventors: William Shott, Park City, UT (US); Robert John Morrison, Sandy, UT (US)

(73) Assignee: Hammerton, Inc., Salt Lake City, UT (US)

( * ) Notice: Subject to any disclaimer, the term of this patent is extended or adjusted under 35 U.S.C. 154(b) by 0 days.

(21) Appl. No.: 17/550,843

(22) Filed: Dec. 14, 2021

(51) Int. Cl.

| | |
|---|---|
| ***F21V 27/00*** | (2006.01) |
| ***F21V 21/03*** | (2006.01) |
| ***F21V 17/08*** | (2006.01) |
| ***F21S 8/06*** | (2006.01) |

(52) U.S. Cl.
CPC ..... *F21V 27/00* (2013.01); *F21S 8/061* (2013.01); *F21V 17/08* (2013.01); *F21V 21/03* (2013.01)

(58) Field of Classification Search
CPC ..... F21V 21/00; F21V 27/00; F21V 17/08; F21V 21/03; F21V 21/008; F21S 8/061; F21S 8/06; F21S 8/04; B65H 75/14; B65H 75/28; B65H 75/446; B65H 75/48
USPC ..... 242/614, 388, 388.1, 400, 402, 404; 362/404, 391
See application file for complete search history.

(56) References Cited

U.S. PATENT DOCUMENTS

| | | | | |
|---|---|---|---|---|
| 486,604 | A * | 11/1892 | Porter | |
| 745,670 | A * | 12/1903 | Riley | |
| 1,005,902 | A | 10/1911 | Taylor | |
| 1,117,869 | A | 11/1914 | Lindahl | |
| 1,659,160 | A | 2/1928 | Richards | |
| 4,187,996 | A | 2/1980 | Ehrlich | |
| 5,255,866 | A * | 10/1993 | Campolo | H01R 13/6392 24/910 |
| 5,558,288 | A * | 9/1996 | Brovelli | B65H 75/28 242/130.2 |
| 6,612,515 | B1 * | 9/2003 | Tinucci | B65H 75/143 242/612 |
| 6,758,581 | B2 | 7/2004 | Weinhuber | |

(Continued)

FOREIGN PATENT DOCUMENTS

| | | | |
|---|---|---|---|
| DE | 175565 | C | 11/1906 |
| DE | 822381 | C | 11/1951 |

(Continued)

*Primary Examiner* — Laura K Tso
(74) *Attorney, Agent, or Firm* — Edell, Shapiro & Finnan, LLC

(57) ABSTRACT

A canopy for varying the height of a lighting fixture suspended from a ceiling or elevated support structure via the cable/cord supplying power to the lighting fixture. The canopy has a notched spool mounted non-rotatably to the ceiling or elevated support structure. The spool has a core part around which the power cable/cord is wrapped to change the effective length of cable/cord. A revolving hook bolt is connected to the spool such that the bolt can be rotated to face a notch through which the cable/cord has been inserted. The hook bolt has a rounded edge bump that the cable/cord passes through after exiting the notch. The edge bump is configured to securely retain the cable in a fixed position without slippage and to support the weight of the suspended lighting fixture in a secure slip-free manner.

20 Claims, 10 Drawing Sheets

(56) References Cited

U.S. PATENT DOCUMENTS

| | | | | |
|---|---|---|---|---|
| 7,178,754 | B2 * | 2/2007 | Anderson | B65H 75/18 242/402 |
| 7,311,425 | B2 | 12/2007 | Jervey, III | |
| 8,931,936 | B1 | 1/2015 | Tham et al. | |
| 9,068,725 | B1 | 6/2015 | Kuykendall et al. | |
| 9,175,835 | B2 | 11/2015 | Machiorlette | |
| 2007/0134093 | A1 | 6/2007 | Weiler | |
| 2011/0026252 | A1 | 2/2011 | Janos et al. | |
| 2014/0145129 | A1 | 5/2014 | Bauder | |
| 2016/0072233 | A1 * | 3/2016 | Martin | F21S 8/04 439/529 |

FOREIGN PATENT DOCUMENTS

| | | | |
|---|---|---|---|
| DE | 1765470 | U | 4/1958 |
| DE | 3210793 | A1 | 10/1982 |
| DE | 4413381 | A1 | 10/1994 |
| GB | 2274966 | A * | 8/1994 |

* cited by examiner

ADJUSTABLE-LENGTH CEILING-MOUNTED CANOPY FOR A LIGHTING FIXTURE

FIELD OF THE INVENTION

The present invention generally relates to lighting fixtures, and more particularly to a canopy for suspending a lighting fixture from a ceiling or other elevated support structure such that the height of the lighting fixture may be adjusted according to a user's needs.

BACKGROUND OF THE INVENTION

Many luminaires and lighting fixtures providing ambient and task lighting in residential and commercial locations are suspended from a ceiling at selected heights by the power cord used to supply the suspended lighting fixtures with electrical power. For functional and aesthetic purposes, however, it is frequently necessary to adjust the height of the lighting fixtures after installation, particularly when a series of ceiling mounted lighting fixtures, for example, a series of pendant lighting fixtures, are to be hung at identical or different heights.

Generally, lighting fixtures that are hung from a ceiling by the power cord used to supply the fixtures with electrical power typically include a winding mechanism around which the power cord is wrapped. The winding mechanism is usually configured as a rotatable spindle, reel, spool, or drum. When the winding mechanism of these lighting fixtures is rotated, the height of the lighting fixtures can be adjusted in relation to, for example, a piece of furniture, a countertop or the floor, by changing the effective length of the power cord. That is, rotation of the spindle, reel, spool, or drum permits the lighting fixtures to be raised and lowered by either shortening or lengthening the power cord, thus enabling the lighting fixtures to be suspended at any desired height.

Nevertheless, the typical winding mechanisms used to adjust the effective length of the power cord in ceiling hung lighting fixtures employ a complex combination of interrelated moving parts that complicates assembly of the lighting fixtures and makes height adjustment of the fixtures more difficult. Examples of ceiling mounted lighting fixtures that include various winding mechanisms (e.g., spindles, reels, spools, and drums) for adjusting the length of the power cord supplying the lighting fixture with electrical power may be found, for example, in several patent documents, including U.S. Pat. No. 9,175,835 (Machiorlette); U.S. Pat. No. 7,311,425 (Jervey, III); U.S. Pat. No. 6,758,581 (Weinhuber); U.S. Pat. No. 1,117,869 (Lindahl); U.S. Pat. No. 486,604 (Porter); DE Patent Application No. 3210793 (Napierski); and DE Patent No. 175565 (Quincy). The entire disclosures in all of these documents are incorporated herein by reference.

While the winding mechanisms described in these prior art patents and publications may fulfill their stated objectives and, at first appearance, may have similarities with the present invention, they differ in many material aspects. The differences, which will be described in more detail below, are not only necessary for the successful use of the present invention, but provide advantages that are not available with the winding mechanisms of the prior art. Thus, the present invention substantially departs from the conventional solutions and addresses the needs of the lighting industry for an inexpensive yet strong and sturdy power cord winding mechanism that is less complex and much simpler to use, while still providing all the benefits of the prior art devices described above.

SUMMARY OF THE INVENTION

According to one aspect of the present invention, an inexpensive and easily moldable canopy is provided that is mountable to a ceiling or other elevated support structure for adjustably hanging a lighting fixture (e.g., a pendant lighting fixture). The canopy (also referred to herein as an adjustable-length canopy and ALC) comprises a notched spool that allows the lighting fixture cable (i.e., the cord supplying the lighting fixture with electrical power) to be wrapped (wound) around a core part such that the overall length of the cable (power cord) can be varied. Varying the length of the cable permits the height of the lighting fixture to be adjusted and/or set to a position selected according to a user's needs. The canopy device further includes a hook bolt rotationally attached to the notched spool using a threaded cap fastener. The cable (power cord), after being wound around the core part of the notched spool, is affixed to the hook bolt to secure the lighting fixture at the height selected by a user.

According to another aspect of the present invention, the hook bolt extends through a central access opening (aperture) in the notched spool and has a rounded edge bump to retain the cable (power cord) after the cable exits the notched spool. The rounded edge bump configuration allows for secure retention of the cable without slippage. Thus, the hook bolt maintains the position of the cable, as well as supports the weight of the suspended lighting fixture, in a secure slip-free manner.

According to a further aspect of the present invention, a canopy cover encases (encloses) the ALC components in order to protect the components from damage. In addition, the canopy cover enhances the aesthetics of the ALC by providing a more pleasing appearance.

According to an additional aspect of the present invention, a hook bolt cap is removably screwed onto an exposed end of the hook bolt that extends outward from the canopy cover to lock the canopy cover securely in place against the ceiling or other elevated support structure.

BRIEF DESCRIPTION OF THE DRAWINGS

Embodiments of the present invention are described herein in conjunction with the accompanying drawings, in which.

DETAILED DESCRIPTION OF THE INVENTION

Figure 1:
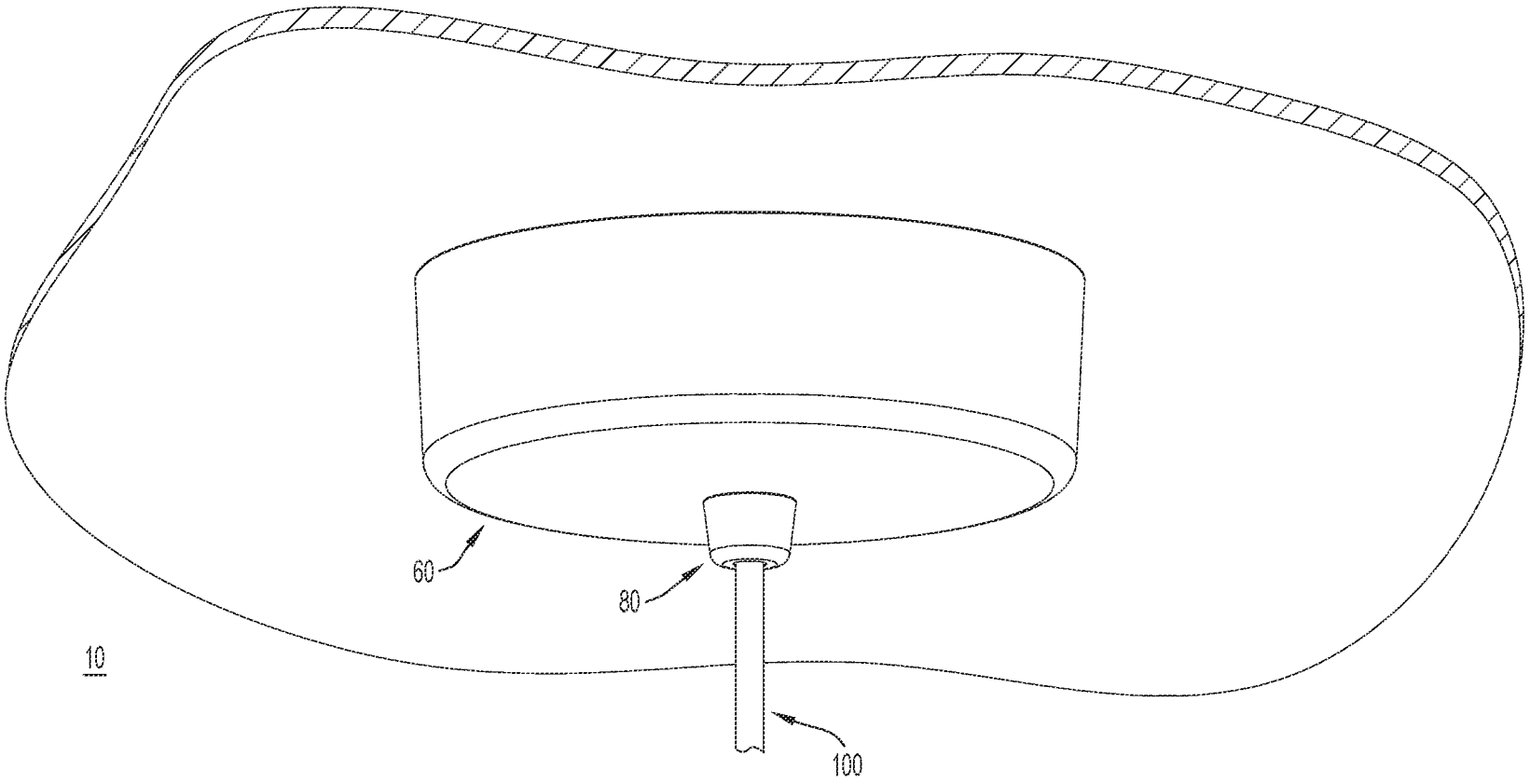
FIG. 1 is a perspective view from below illustrating an example embodiment of the canopy (ALC) of the present invention with the canopy cover and hook bolt cap attached.
Figure 2:
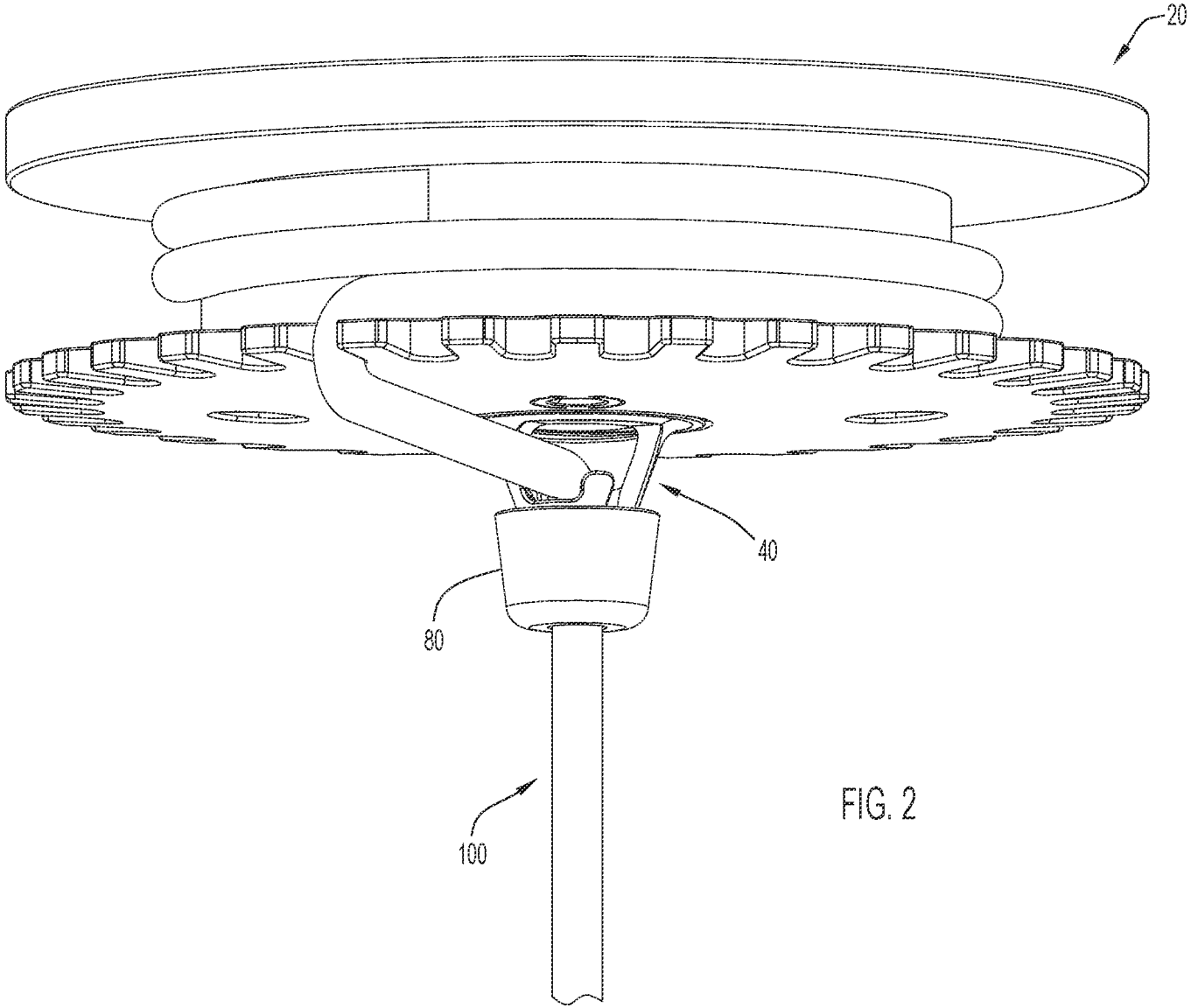
FIG. 2 is a perspective view from below of the canopy (ALC) of FIG. 1, with the canopy cover removed, illustrating the cable (power cord) wrapped around a core part of the notched spool, the hook bolt attached to the notched spool, and the hook bolt cap connected to the hook bolt in accordance with certain aspects of the present invention.

Referring to the drawings and initially to FIGS. 1 and 2, there is illustrated an example embodiment of the canopy 10 for adjustably hanging a lighting fixture (e.g., a pendant lighting fixture—not shown) from a ceiling or other elevated support structure. The canopy (also referred to herein as adjustable length canopy and ALC) comprises four main parts, namely: a circular notched spool 20, a hook bolt 40, a circular canopy cover 60, and a hook bolt cap 80. The notched spool 20 allows the lighting fixture cable (i.e., the power cord supplying the lighting fixture with electrical power) 100 to be wrapped (wound) around a circular core part 22 (FIG. 9) such that the overall length of the cable (power cord) may be varied. Varying the length of the cable permits the height of the lighting fixture to be adjusted and/or set to a position selected according to a user's needs. The hook bolt 40 is rotationally affixed to the notched spool 20 in such a manner that the hook bolt can revolve 360° about a longitudinal axis A-A extending through a central access opening (aperture) 21 of the spool (FIG. 5).

Figure 3:
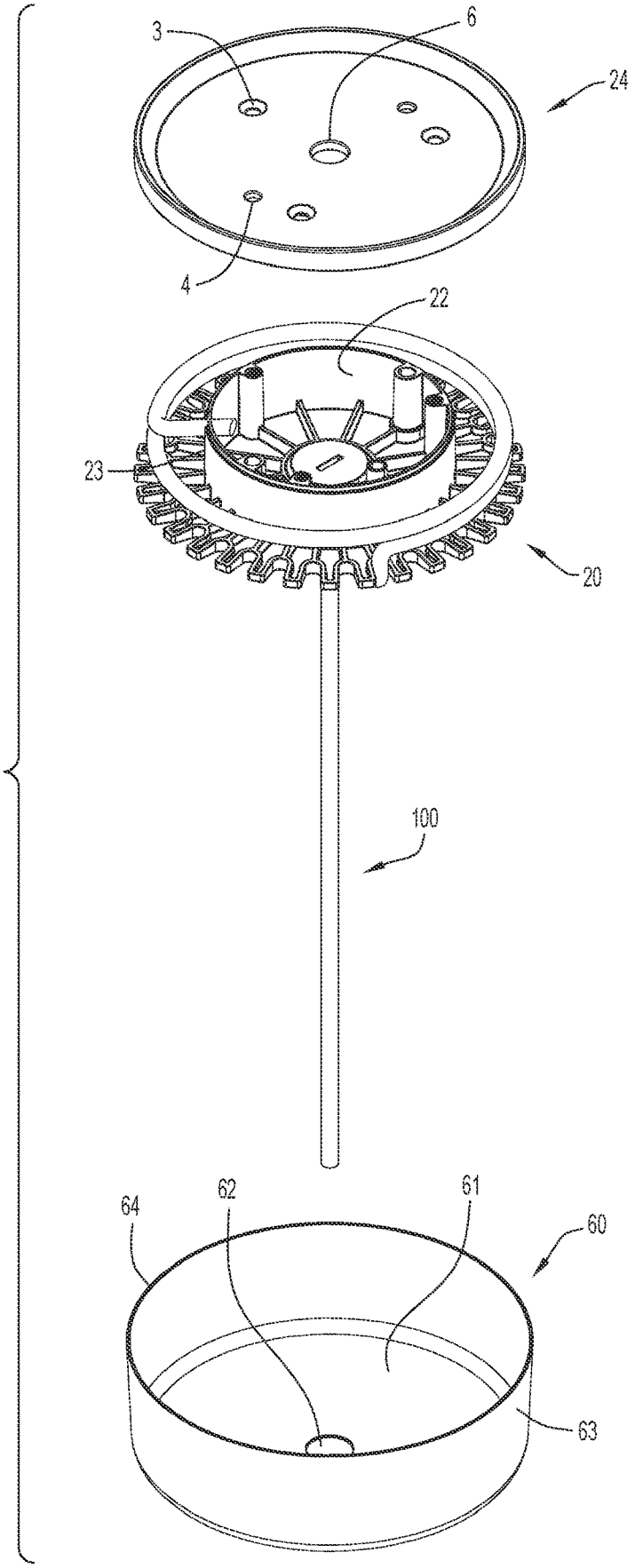
FIG. 3 is a partial exploded view of the notched spool illustrating the base plate of the spool and the canopy cover disassembled to emphasize components of the spool and the cable (power cord) wrapped around a core part of the spool, in accordance with certain aspects of the present invention.

With reference to FIG. 3, a circular base 24, which forms part of ALC 10 of the present invention, is shown removed from the notched spool 20 in order to permit illustration of the various components of the spool arranged within the core part 22. As shown, the circular base 24 includes a plurality of countersunk holes 3 to allow machine screws 2 (FIG. 10) to pass therethrough for affixing the base 24 to the notched spool 20. While the number of countersunk holes shown in the example embodiment is three, it will be readily apparent that the precise number of holes may vary without departing from the scope of the invention. For example, the number of countersunk holes could be two or four. The circular base 24 may be made of any suitable electrically non-conductive or insulator material, such as, but not limited to, plastic, fiberglass, and composite materials.

Figure 10:
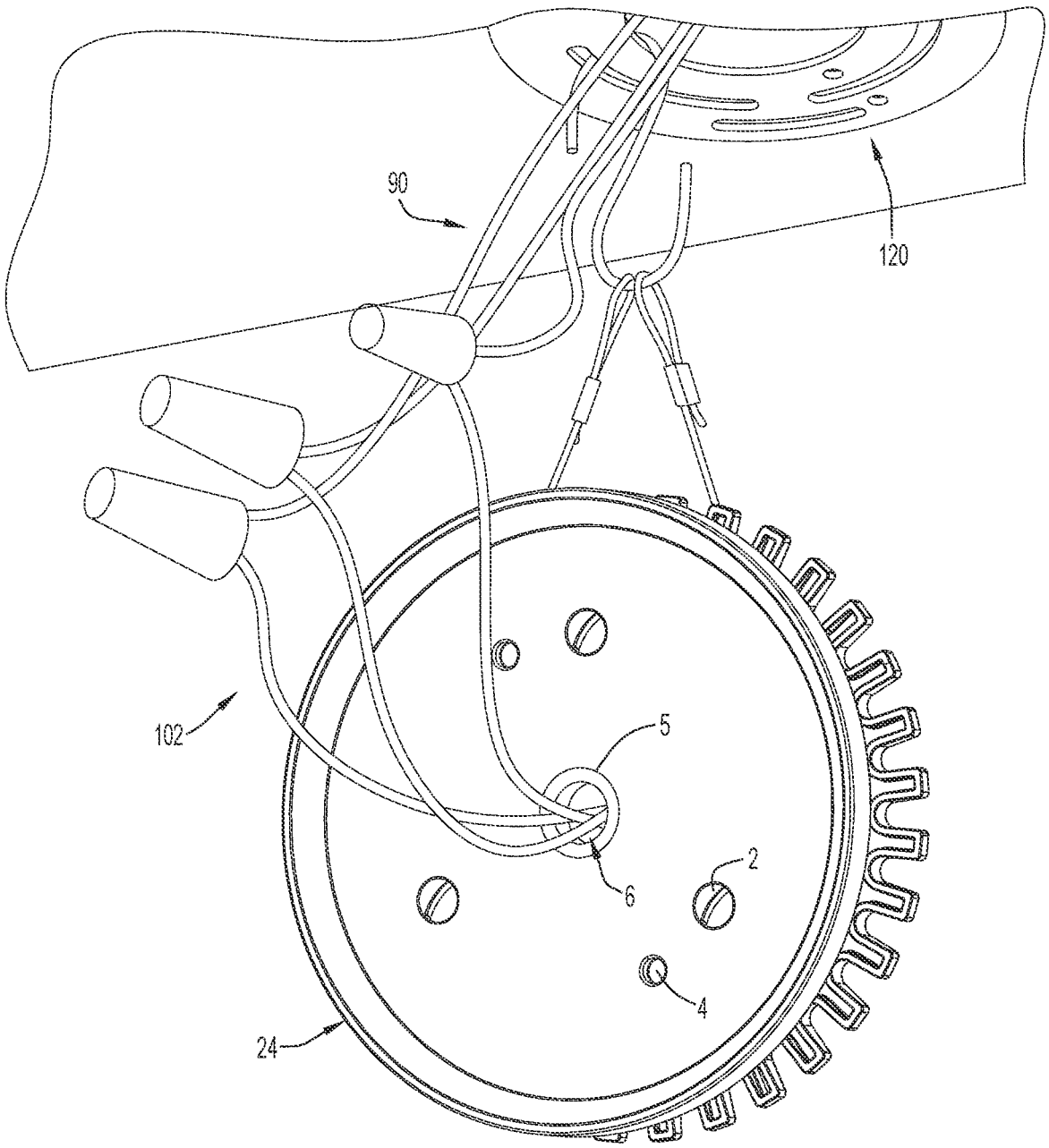
FIG. 10 is a perspective view from below, right, showing the notched spool of FIG. 8 with the base plate attached and electrical wires from the cable (power cord) extending through a grommet in the base plate and connected to electrical wiring contained in a junction box attached to a ceiling or other elevated support structure in accordance with certain aspects of the present invention.

In addition to countersunk holes 3, the circular base 24 includes a pair of diametrically opposed mounting through holes 4 and a central access through opening (aperture) 6. The mounting holes 4 permit machine screws or bolts 7 (FIG. 8) to pass through for affixing the ALC 10 to a ceiling or other elevated support structure, while central access opening 6 allows individual electrical wires 102 of cable (power cord) 100 to pass through for connection to electrical wiring 90 contained within a junction box (FIG. 10). A grommet 5 is arranged within central access opening (aperture) 6 to prevent the electrical wires 102 from being damaged (FIG. 10). While the grommet may be formed from any suitable material, it is preferably molded from a synthetic material such as, for example, silicon.

Figure 4:
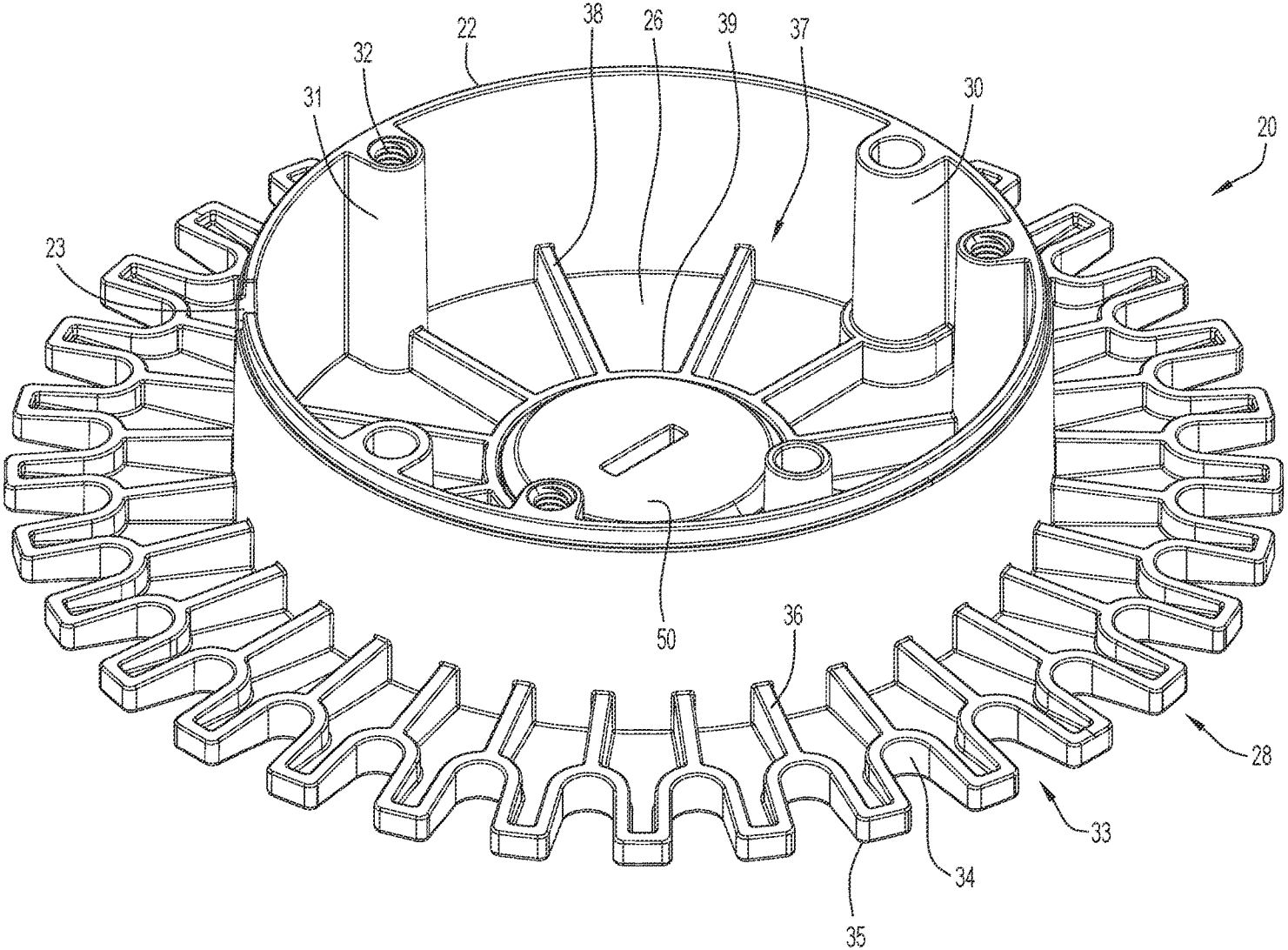
FIG. 4 is an enlarged perspective view from above illustrating the first (upper) side of the notched spool to emphasize spool components, as well as the cap fastener arranged to affix the hook bolt to the spool, in accordance with certain aspects of the present invention.
Figure 5:
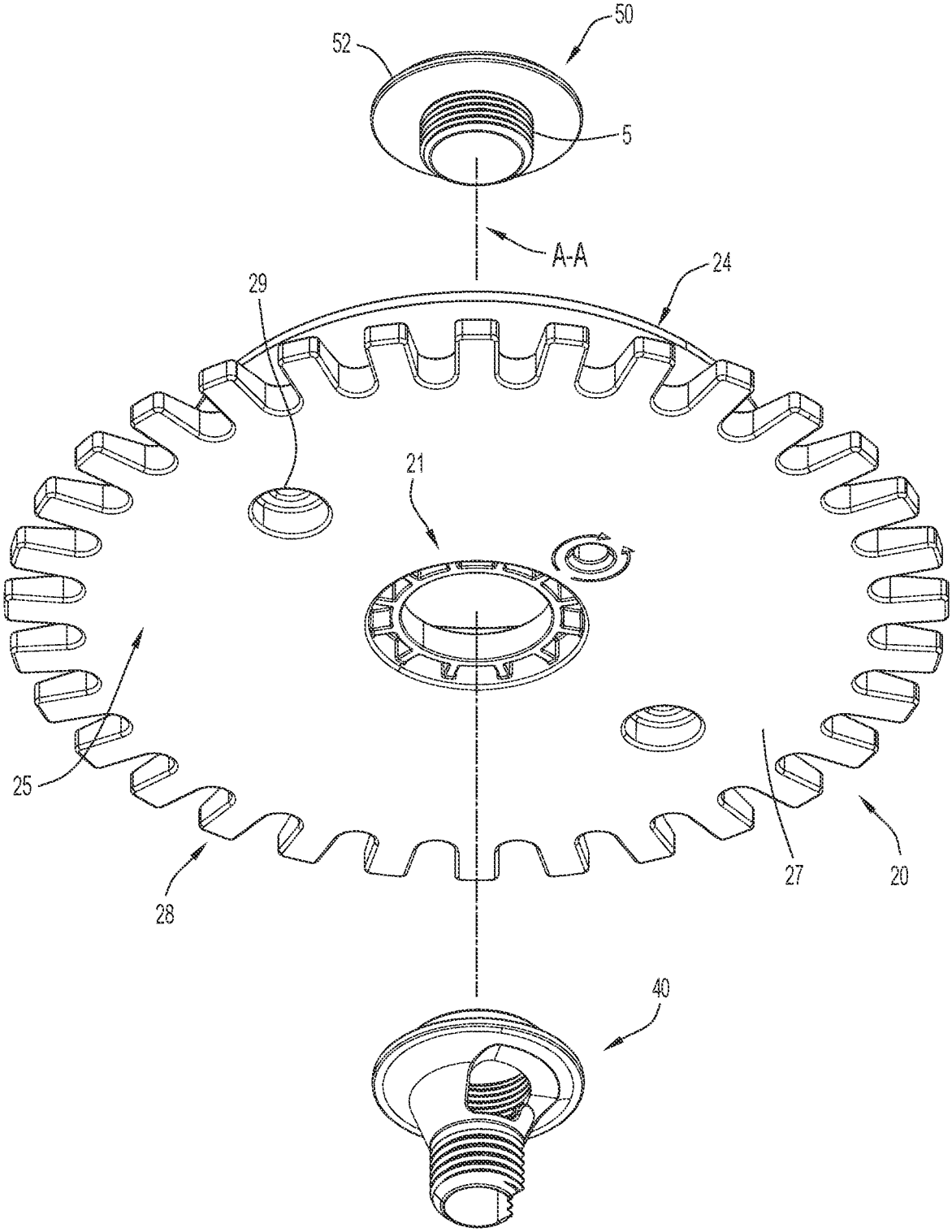
FIG. 5 is an enlarged perspective view from below illustrating the second (lower) side of the notched spool including the central access opening for rotationally accommodating the hook bolt and a pair of spaced apart holes extending through the spool for insertion of mounting screws, as well as the hook bolt and the cap fastener prior to being joined to the spool, in accordance with certain aspects of the present invention.
Figure 8:
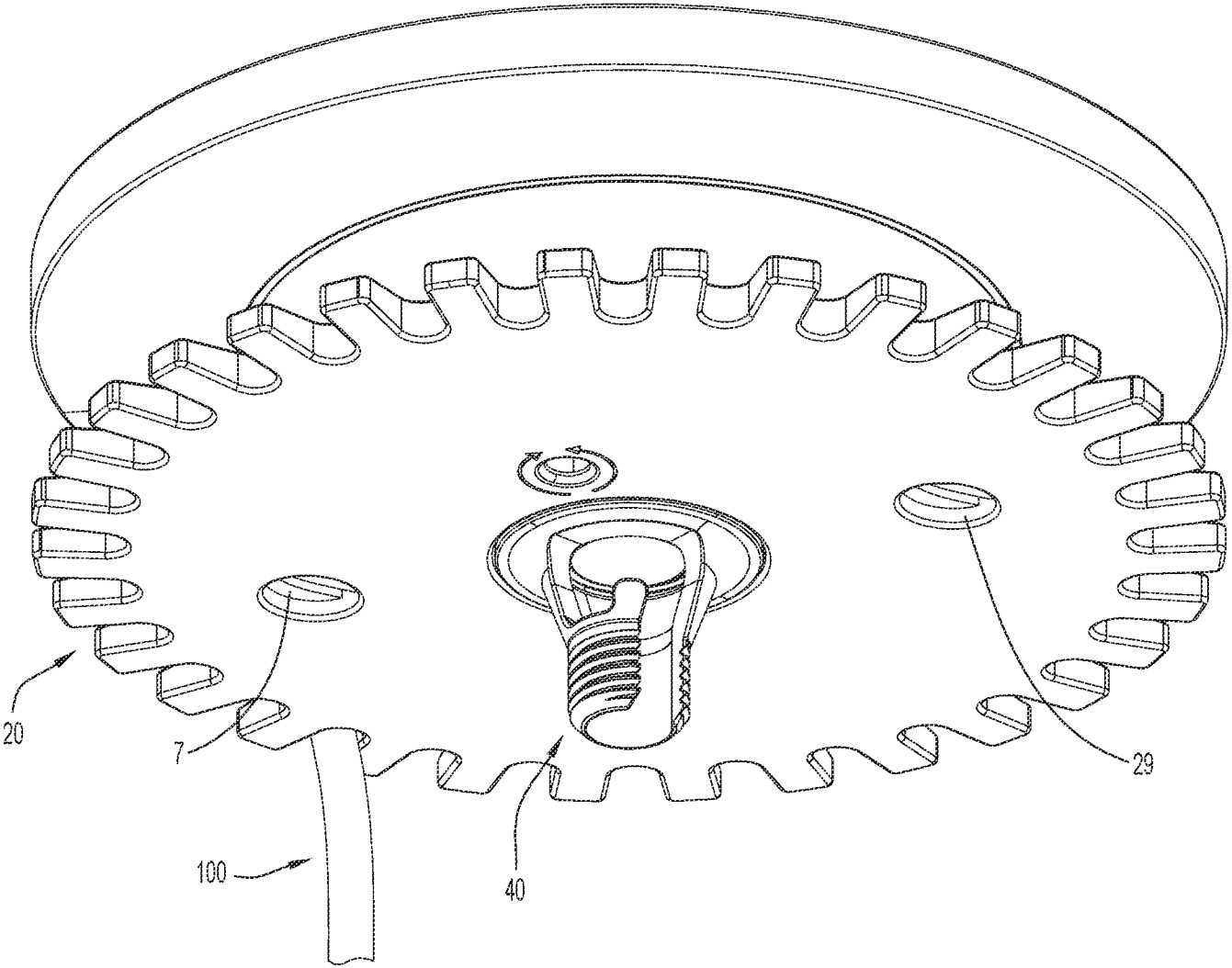
FIG. 8 is an enlarged perspective view from below illustrating the notched spool of FIG. 2 with the hook bolt attached and the cable (power cord) positioned within one of the notches on the periphery of the spool in accordance with certain aspects of the present invention.

Referring to FIGS. 3-5, the notched spool 20 of the present invention comprises a circular body 25 having a first or upper side 26 and a second or lower side 27. The circular body further includes a central access opening (aperture) 21 extending between the first (upper) and second (lower) sides, an outer peripheral edge 28, and a pair of through holes 29. Each through hole 29 is sized to receive machine screws or bolts 7 (FIG. 8). The machine screws engage with threaded holes in a universal mounting bracket 120 that is attached to a junction box to secure the notched spool 20 to a ceiling or other elevated support structure (FIG. 10) in a non-rotatable manner. The notched spool 20 preferably is made from a non-conductive or insulator composite material, such as, for example, a composite nylon and glass material, and is preferably formed utilizing an injection molding process. However, other suitable materials, such as, for example, metal and thermally conductive injection molded plastics may be used to make the notched spool. Further, the notched spool may be formed by utilizing manufacturing processes other than injection molding.

As shown in FIGS. 4 and 5, the notched spool 20 has a hollow core part 22 comprising an upstanding annular (circular) wall defining an enclosed inner area. The annular (circle) wall of core part 22 is integrally formed upon the first (upper) side 26 between the central access opening (aperture) 21 and outer peripheral edge 28 of the notched spool. The annular (circular) wall of core part 22 is concentric with the outer periphery of the spool and projects upward from the first (upper) side 26 a sufficient distance to permit multiple loops (turns) of the cable (power cord) 100 may be wrapped (wound) around the exterior surface of the wall of core part 22 such that the height of a lighting fixture (not shown) can be adjusted in relation to, for example, a piece of furniture, a countertop or the floor, by changing the effective length of the cable. Typically, the core part 22 is molded to the first (upper) side 26 of the notched spool 20 by an injection molding process. However, the core part may be affixed to the upper side of the notched spool in any other suitable manner, for example, using adhesive or a heat process. Additionally, the upstanding annular wall of core part 22 has a distal (upper) edge containing a through notch 23 suitably shaped to receive cable 100 (FIGS. 2, 3 and 4). As used herein, the term "distal edge" will always refer to the edge of the wall of core part 22 that is remote from the first (upper) side 26 of circular body 25.

As further illustrated in FIG. 4, a pair of diametrically opposed upright projections 30 is positioned within the inner area and affixed to the interior surface of the annular (circular) wall of core part 22. Typically, the projections 30 are molded to the interior wall surface of core part 22 using an injection molding process. As shown, the projections 30 are configured as elongated, hollow tubes of generally cylindrical configuration, each having an open proximal (lower) end and an open distal (upper) end. As used herein, the term "proximal end" will always refer to the end of the projection closest to the first or upper side 26 and the term "distal end" will always refer to the end of the projection remote from the first or upper side 26. The proximal ends of the diametrically opposed projections 30 are aligned with through holes 29 to permit machine screws (bolts) 7 to pass therethrough.

Referring again to FIG. 4, a plurality of spaced apart upright projections 31 are positioned within the inner area and fastened to the interior surface of the annular (circular) wall of core part 22. The projections 31 are typically equidistant, being angularly spaced about the interior surface of the wall of core part 22. While the number of upright projections 31 shown in the example embodiment is three, it will be readily apparent that the precise number of upright projections 31 may vary without departing from the scope of the invention. For example, the number of upright projections could be two or four. As shown, the projections 31 are configured as elongated posts of generally cylindrical configuration, each having a proximal (lower) end and a distal (upper) end. Again, as used herein, the term "proximal end" will always refer to the end of the projection closest to the first or upper side 26 and the term "distal end" will always refer to the end of the projection remote from the first or upper side 26. A threaded recess 32 configured to receive machine screws 2 is formed in the distal (upper) end of each projection (post) 31. The machine screws 2, as mentioned herein, are used to removably attach base plate 24 to notched spool 20, as shown in FIG. 10.

Again referring to FIGS. 4 and 5, the notched spool 20 of the example embodiment comprises a plurality of notches 33 circumferentially spaced around the outer periphery of circular body 25. The notches are molded about the outer periphery of the circular body 25 in a conventional manner, for example, using an injection molding process. The apex 34 of each notch 33 is rounded to snugly accommodate the typically rounded cable (power cord) 100 that supplies electrical power to the lighting fixture (not shown). Further, each notch 33 has outer corners 35 that are rounded to eliminate sharp edges that could damage the cable 100.

Referring back to FIG. 4, a plurality of reinforcing ribs 36 extend radially outward from the exterior surface of the annular wall of core part 22. As shown, each circumferentially spaced notch 33 is connected to one of the plurality of reinforcing ribs 36. The reinforcing ribs are provided to structurally strengthen the circular body 25, as well as the circumferentially spaced notches 33 that extend outward from the outer periphery of circular body 25. The reinforcing ribs 36 preferably are injection molded to first (upper) side 26 of the circular body 25, as well as to the exterior surface of the wall of core part 22 and the raised structure defining the apex of each notch 33. However, the ribs 36 may be fastened to the notched spool 20 in any other suitable manner. For example, but not limited to, the ribs 36 may be fastened to the circular body 25, the exterior surface of the wall of core part 22, and the raised structure defining the apex of each notch 33 using an adhesive or a heat process.

A stiffening structure 37 is situated within the inner area of hollow core part 22, as shown in FIG. 4. The stiffening structure 37 has a spoke-shaped configuration that improves the strength of the circular body 25 as well as the core part 22. As shown, the stiffening structure 37 includes a plurality of spaced radial ribs 38 extending outward from an annular rib 39 surrounding central access opening (aperture) 21. The radially extending ribs 38 are connected to the interior surface of the wall of core part 22, as well as the outer surfaces of projections 30 and 31, to structurally strengthen each of these components. The stiffening structure 37 is preferably molded to first (upper) side 26 of the circular body 25, the interior wall surface of core part 22, and the outer surface of projections 30 and 31 using an injection molding process. However, the stiffening structure 37 may be fastened to the notched spool 20 in any other suitable manner. For example, but not limited to, the stiffing structure 36 may be fastened to the circular body 25, the interior surface of the wall of core part 22, and the upright projections 30, 31 using an adhesive or a heat process.

As further shown in FIG. 4, a cap fastener 50 is arranged within the annular rib 39 of stiffening structure 37. The cap fastener 50 is configured to attach the hook bolt 40 to the notched spool 20 in such a manner that the hook bolt may revolve within the central access opening (aperture) 21 about a longitudinal axis A-A (FIG. 5). The hook bolt 40, as well as the cap fastener 50, will be described in more detail below.

In an unillustrated example embodiment of the present invention, a printed circuit board (PCB) can be housed within the inner area defined by the annular (circular) wall of core part 22 to regulate the high voltage delivered to the hanging lighting fixture. For example, but not limited to, the PCB may convert incoming 120V AC line voltage power to outgoing 120V DC voltage power. However, if a low-voltage lighting fixture is to be hung, a PCB can be housed within the inner area of the core part to convert the incoming high AC voltage power to outgoing low voltage DC power. The PCB may include conventional components, such as rectifiers, diodes and capacitors, for the regulation of voltage.

Figure 6:
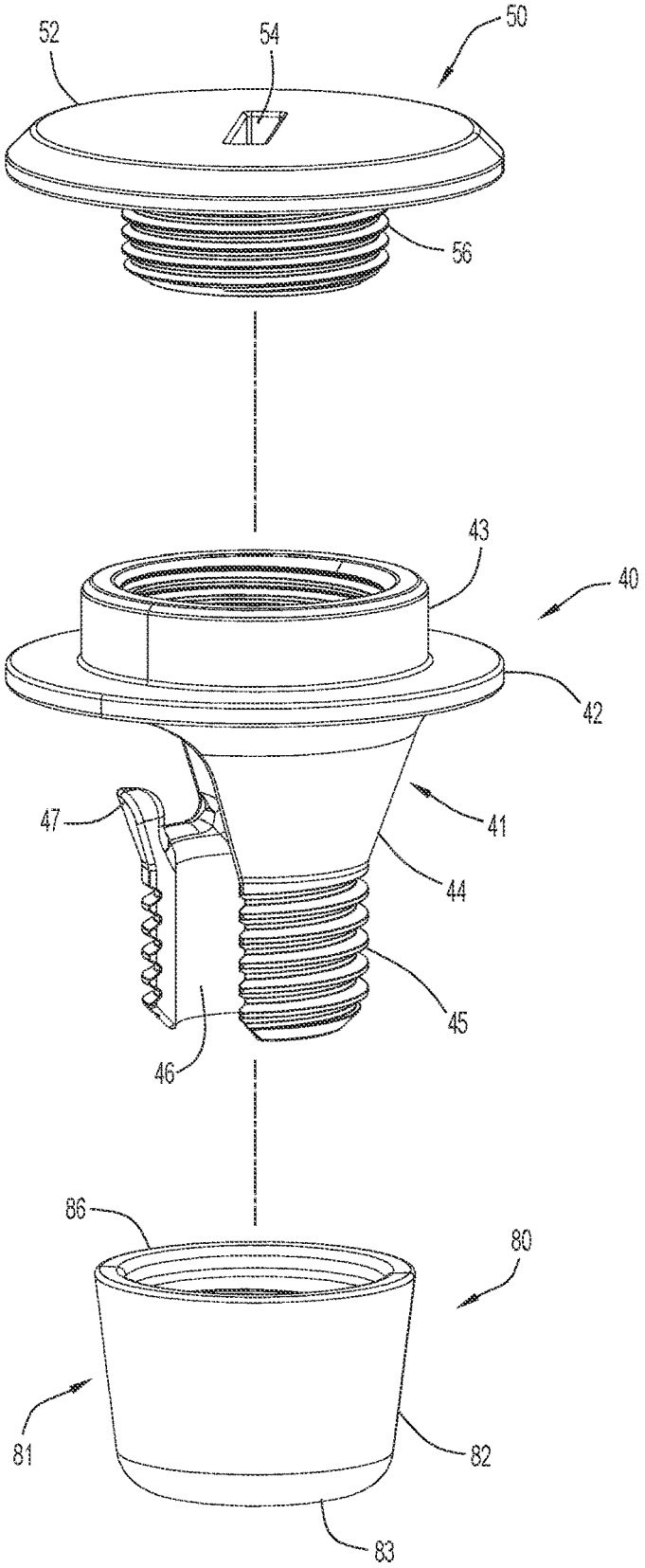
FIG. 6 is an exploded perspective view from above illustrating details of the hook bolt, as well as the cap fastener and hook bolt cap prior to being joined to the hook bolt, in accordance with certain aspects of the present invention.
Figure 9:
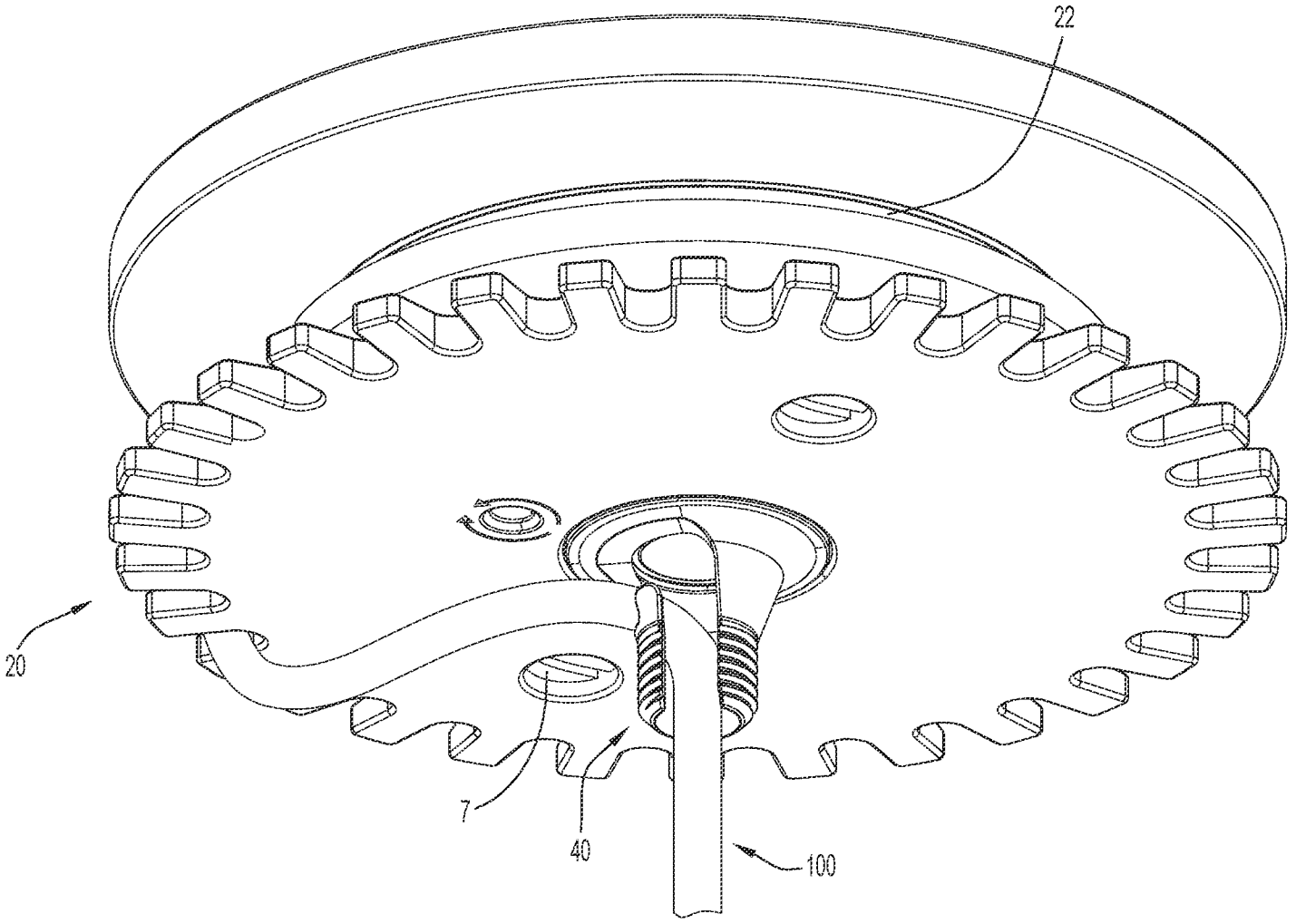
FIG. 9 is an enlarged perspective view from below of the notched spool of FIG. 8 illustrating the cable (power cord) wrapped around a core part of the spool, as well as positioned within a selected notch on the periphery of the spool and subsequently threaded through an interior portion of the hook bolt, in accordance with certain aspects of the present invention.

Focusing now on FIGS. 5 and 6, the hook bolt 40 is provided for the purpose of securely holding the cable (power cord) 100 to the canopy 10 after the cable exits the notched spool 20 (FIGS. 2 and 9). As shown, the hook bolt 40 comprises a generally asymmetrically shaped hollow elongated body 41 having a collar 42 of circular configuration protruding outward therefrom. The hollow elongated body 41 includes a wall with an internally threaded tubular (hollow) first section 43 projecting upward from a first (upper) surface of collar 42, a tapering tubular (hollow) second section 44 projecting downward from a second (lower) surface of the collar 42, and an externally threaded tubular (hollow) third section 45 projecting downward from a lower end of the tapering second section 44. The third section 45 has an open distal end that is remote from the lower end of the tapering second section 44. The elongated body 41 of the hook bolt is preferably made from an electrically non-conductive or insulator plastic material using an injection molding process. For instance, the plastic material may be any one of numerous synthetic plastic substances that are typically utilized in the electrical industries for the making of electrical insulating parts, for example, but not limited to, Polytetrafluoroethylene (PTFE).

As further shown in FIGS. 5, 6, 8, and 9, the second and third sections of the wall have an elongated slot 46 that is formed as a continuous through opening (e.g., the slot extends from the exterior surface of the wall to the interior surface of the wall) and provides access for insertion of the cable (power cord) 100 into the hollow interior of the elongated body 41 after the cable (power cord) has been positioned (inserted) within one of the notches 33 of spool 20 (FIG. 9). As best shown in FIGS. 8 and 9, the slot 46 extends downward from the second (lower) surface of the collar 42 to the remote distal end of third section 45. As also shown in FIGS. 5, 6, 8, and 9, the second section 44 is provided with a rounded edge bump 47 to ensure that cable 100, once inserted through slot 46 and into the interior of the hollow elongated body 41, does not slip out of the slot during screwing and unscrewing of the bolt cap 80. The rounded edge bump 47, as best illustrated in FIG. 6, is arranged adjacent slot 46 and has a curvature that bends slightly outward toward the outside of the elongated body 41 such that the cable (power cord) 100 is securely, but releasably retained within the slot 46, as described herein.

Again with reference to FIGS. 5 and 6, the cap fastener 50 includes a flat disk-shaped head 52 having a slot 54 formed therein for receiving a screwdriver (or other suitable tool) and a threaded shank 56 extending outward from an underside of the disk-shaped head 52. The threaded shank 56 has threads complementary to the threads of the internally threaded tubular (hollow) first section 43. The complementary threads are sized and shaped to allow the threaded shank to be received within the tubular (hollow) first section 43 in such a fashion as to permit hook bolt 40 to be attached within the central access opening (aperture) 21 of the notched spool 20 in a manner that spaces the first (upper) surface of collar 42 a minimal distance from the second (lower) surface of circular body 25. The minimal distance may be, for example, a controlled unit of measurement, such as, but not limited to, approximately 0.1 mm, to ensure free rotation. This minimal distance (spacing) is an important aspect of the present invention since it allows the hook bolt 40 to smoothly rotate (i.e., revolve) within the central access opening (aperture) 21 without creating friction. In other words, the hook bolt 40 revolves within the access opening 21 in a generally frictionless manner such that it can smoothly rotate 360° to appropriately face any one of the notches 33 that a user has chosen to insert the cable (power cord) 100 during height adjustment of the suspended lighting fixture (not shown).

The cap fastener 50 may be made from an electrically non-conductive or insulator plastic material using an injection molding process. For instance, the plastic material may be any one of numerous synthetic plastic substances that are typically used in the electrical industries for the making of electrical insulating parts, for example, but not limited to, Polytetrafluoroethylene (PTFE). Alternatively, cap fastener 50 may be made from anodized aluminum by a computer numerical control (CNC) machine, such as, for example, a CNC lathe or CNC mill. The advantage of machining a part (component) using a CNC lathe or CNC mill, instead of machining, for example, the part (component) by hand, is that the CNC lathe and CNC mill can take data programmed by an operator from a computer-aided design (CAD) file and create a part (component) to specifications with tight tolerances (for example, but not limited to, tolerance levels of approximately 0.1 mm) at a high rate. Furthermore, the aluminum oxide film formed on the surface of cap fastener 50 (e.g., by an aluminum anodizing electrochemical process) is electrically non-conductive. In addition, the anodized film coating protects the aluminum part (e.g., the cap fastener) against corrosion and is highly resistant to wear.

The example embodiment of the ALC 10 described herein further comprises a canopy cover 60 and a hook bolt cap 80, as illustrated in FIGS. 1 and 3. The canopy cover 60, as shown in FIG. 3, has a generally circular bowl-shaped configuration that includes a bottom wall 61 with a hole 62 provided in the center thereof through which the cable (power cord) 100 passes, and a continuous cylindrical side wall 63 extending upward from the bottom wall and terminating at a top edge 64. The canopy cover 60 encloses (encases) the notched spool 20 and the hook bolt 40 to prevent these components from damage. In addition, the canopy cover is provide to enhance the aesthetics of the adjustable length canopy by providing a more pleasing appearance. Even though the canopy cover 60 of the example embodiment is shown as being of a circular configuration, it is understood that any other suitable geometric shape/contour may be utilized as long as the selected shape/contour is capable of permitting/providing the functions described herein.

Figure 7:
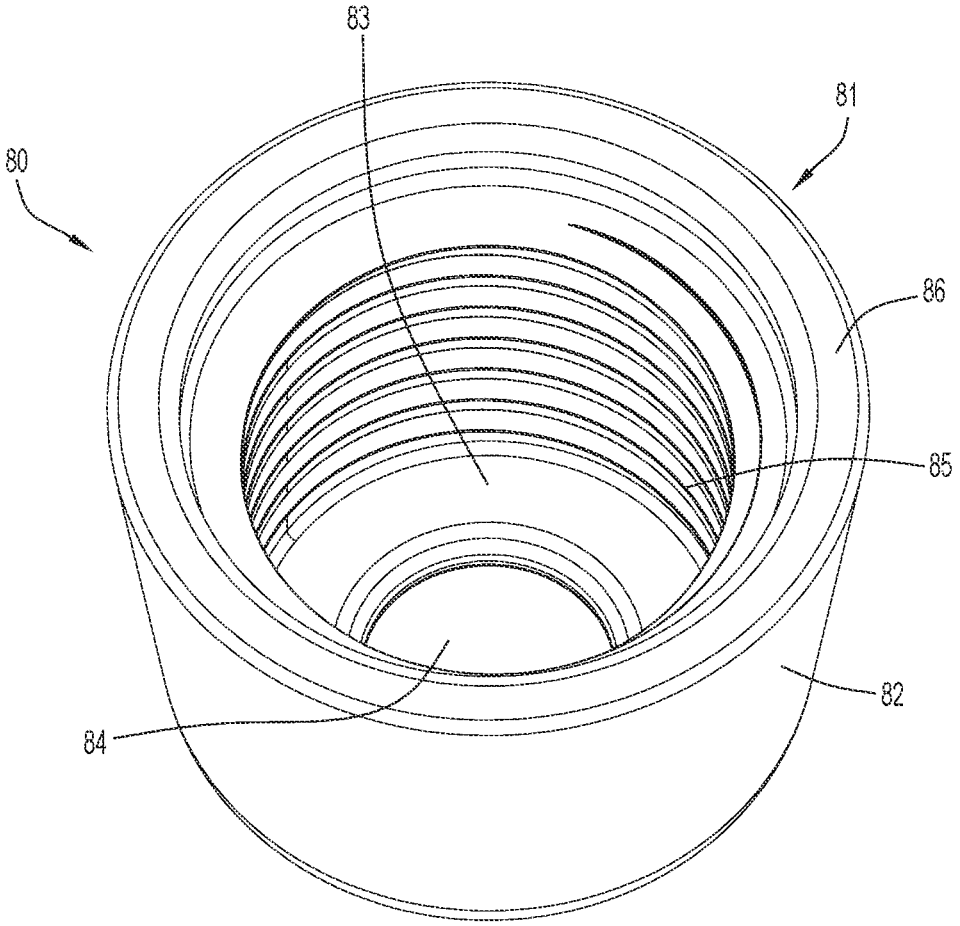
FIG. 7 is a perspective view from above, right, illustrating the threaded interior passage of the hook bolt cap in accordance with certain aspects of the present invention.

Referring now to FIGS. 2, 6, and 7, the hook bolt cap 80 comprises a cylindrically-shaped shell 81 having a continuous side wall 82 with a tapered exterior configuration and a bottom wall 83 with a hole 84 provided in the center thereof through which the cable (power cord) 100 passes. The shell 81 has an internally threaded open passage 85 extending from an open upper end 86 to the bottom wall 83. The internal threads of hook bolt cap 80 engage the external threads of the tubular (hollow) third section 45 of hook bolt 40 to secure the top edge 64 of the canopy cover 60 flush against the ceiling or other elevated support structure (FIG. 1). Those skilled in the art will readily appreciate that utilizing the hook bolt cap 80 to secure the canopy cover against the ceiling or other elevated support structure eliminates the need for additional mounting holes in the canopy cover 60, thereby improving the overall aesthetics of the ALC 10. Moreover, even though the hook bolt cap 80 of the example embodiment of the present invention is illustrated as a cylindrically-shaped shell, it is understood that any other suitable geometric shape/contour can be utilized as long as the selected shape/contour is capable of permitting/providing the functions described herein.

The assembly, installation and operation of the canopy 10 is believed to be readily apparent from the above description of the example embodiment of the present invention presented herein. Nevertheless, a brief description of the assembly, installation and operation of the canopy of the present invention will be provided below.

At the outset, the hook bolt cap 80, canopy cover 60, and notched spool 40 may be pre-assembled to cable 100 during manufacture of the lighting fixture. However, it should be appreciated that, rather than pre-assembling these components during manufacture, a user could assemble these components prior to starting the installation process.

Under either of the scenarios described herein, assembly begins with the hook bolt 40 being inserted through the central access opening (aperture) 21 in circular body 25 of notched spool 20. Thereafter, the threaded shank 56 of cap fastener 50 is screwed into the hollow tubular first section 43 of hook bolt 40 (using, for example, a screwdriver or other suitable tool configured to fit within slot 54) to engage with the internal threads of first section 43 in a manner that permits the hook bolt 40 to be rotationally attached within the central access opening 21 of the notched spool 20 in a generally frictionless manner, as described herein.

After the bolt hook 40 is rotationally attached to the notched spool 20, the cable (power cord) 100 that supplies the light fixture (not shown) with electrical power is threaded through the hole 84 provided in the bottom wall 83 of the hook bolt cap 80. Next, the cable (power cord) 100 is threaded through the hole 62 provided in the center of the canopy cover 60. After that, the cable (power cord) 100 is fed through the notch 23 formed at the distal (upper) edge of the annular wall of core part 22 of notched spool 20. The electrical wires 102 extending from an end of cable 100 (FIG. 10) opposite the cable end connected to the lighting fixture (not shown) are then inserted through the grommet 5 arranged within the central through access opening (aperture) 6 in the base plate 24 for later connection to the electrical wiring 90 contained inside the junction box attached to a ceiling or other elevated support structure, as illustrated in FIG. 10.

In accordance with an unillustrated example embodiment of the present invention, if the canopy 10 incorporates a printed circuit board (PCB) within the inner area of core part 22 for regulating voltage, e.g., when a low-voltage pendant lighting fixture is attached to cable 100, the electrical wires 102 are connected to the PCB prior to insertion through grommet 5 in base plate 24.

After wires 102 are passed through grommet 5, the base plate 24 is slid into engagement with core part 22 of notched spool 20 and positioned such that countersunk holes 3 in base plate are in alignment with the threaded openings 32 in upright projections 31. Next, the base plate is affixed to the core part using, for example, the machine screws 2, as shown in FIG. 10. The alignment of countersunk holes 3 with threaded openings 32 likewise aligns mounting holes 4 in base plate 24 with the tubular openings extending through diametrically opposed upright projections 30, as well as through holes 29 in circular body 25. Once the base plate 24 is securely attached to notched spool 20, the ALC 10 is ready to be installed by a user to a ceiling or other elevated support structure.

Now with reference to FIG. 10, the first step of installing the canopy is to attach a universal mounting bracket 120 to a junction box that has been previously secured to a ceiling or other elevated support structure. After that, the ALC 10 is temporarily hung from the universal mounting bracket using, for example, a hanging accessory comprising an S-shaped hook and a short length of wire with a closed loop at each end. However, any other suitable device may be used to temporarily hang the ALC from the universal mounting bracket. Next, the electrical wires 102 are connected to the electrical (e.g., house) wiring 90 contained in the junction box. Standard wire nuts, as shown in FIG. 10, can be used to fasten electrical wires 102 to the electrical (e.g., house) wiring 90. Once wires 102 are fastened to the electrical (e.g., house) wiring 90, the hanging accessory is removed and the wires/wiring, together with their respective wire nuts, are inserted and housed inside the junction box.

Once this installation step is completed, the notched spool 20, with base plate 24 attached, is positioned over the junction box and affixed to the universal mounting bracket using machine screws (bolts) 7. The machine screws (bolts) 7 are insertable into the previously aligned through holes 29 in circular body 25, tubular openings in upright projections 30, and mounting holes 4 in base plate 24 to ultimately engage the threaded holes in the universal mounting bracket 120, as described herein.

With the ALC 10 mounted to the ceiling or other elevated support structure, the suspended light fixture can be easily adjusted to a desired height selected by a user. To adjust the height of the suspended light fixture (not shown), a user merely wraps the cable (i.e., the power cord supplying the light fixture with electrical power) 100 around the exterior surface of the wall of core part 22, thereby changing the length of the cable. Once the desired height is reached, the user simply selects one of the notches 33 circumferentially spaced around the periphery of the circular body 25 that is closest to the cable 100 and inserts the cable snugly into the selected notch, as shown in FIG. 8. Thereafter, the user rotates the hook bolt 40 within central access opening (aperture) 21 to face the appropriately chosen notch 33 and lockingly inserts the cable 100 into the revolving hook bolt 40 utilizing the rounded edge bump 47 arranged adjacent the slot 46 formed in the second section 44 of the hook bolt's elongated body 41. As described herein, the rounded edge bump 47 not only provides for secure retention of cable 100 within slot 46 of hook bolt 40 without slippage, but it additionally supports the weight of the suspended lighting fixture in a secure slip-free manner.

Once the desired height of the lighting fixture is set to its selected position, a user merely slides the canopy cover 60 upward until the top edge 64 of the cover is flush against the ceiling or other elevated support structure, thereby enclosing (encasing) the notched spool 20 and most of the hook bolt 40. After that, a user slides the hook bolt cap 80 upward and screws it onto the portion of the externally threaded tubular third section 45 extending through the center hole 62 provided in the bottom wall 61 of canopy cover 60. As described herein, the internal threads of hook bolt cap 80 engage the external threads of the hollow tubular third section 45 of hook bolt 40 to secure the top edge 64 of canopy cover 60 flush against the ceiling or other elevated support structure (FIG. 1), thereby locking the canopy cover in place.

Again, the purpose of the canopy of the present invention is to provide an inexpensive and easily moldable canopy that can be mounted to a ceiling or other elevated support structure for adjusting the length of the cable (power cord) such that the height of a lighting fixture hanging from the ceiling or other elevated support structure can be varied according to a user's needs. The canopy has four main parts, namely, a notched circular spool, a hook bolt connected to the spool, a round canopy cover enclosing the notched spool, and a hook bolt cap fastened to the hook bolt to retain the canopy cover flush with the ceiling or other elevated support structure. As described herein, a user can change the height of a lighting fixture by merely wrapping the cable (power cord) around the notched spool and, thereafter, locking the cable within the hook bolt to support and retain the lighting fixture at the desired height selected by the user.

The foregoing description of the specific embodiments of the canopy (ALC) of the present invention and the related assembly, installation and operation steps have been presented for purposes of illustration and description. They are not intended to be exhaustive or to limit the invention to the precise forms disclosed. Many modifications and variations are possible in light of the above teachings. The embodiments were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstances may suggest or render expedient, but is intended to cover the application or implementation without departing from the spirit or scope of the claims of the present invention.

Although specific terms are employed herein, they are used in a generic and descriptive sense only and not for purposes of limitation. Thus, it is to be understood that the terms "top", "bottom", "front", "rear", "side", "height", "length", "width", "upper", "lower", "vertical" and the like are used herein merely to describe points of reference and do not limit the present invention to any particular orientation or configuration. Further, it is intended that the present invention covers the modifications and variations of this invention that come within the scope of the appended claims and their equivalents.

What is claimed is:

1. A canopy device mountable to a ceiling or other elevated support structure for supporting a hanging lighting fixture, the canopy device comprising:

a notched spool comprising a circular body having an outer peripheral edge and a central aperture extending between an upper side and a lower side of the circular body, wherein the circular body has a plurality of notches circumferentially spaced around the outer peripheral edge to accommodate a cable supplying the lighting fixture with electrical power; and a hook bolt extending through the central aperture and being affixed rotationally to the circular body.

2. The canopy device of claim 1, wherein the notched spool further comprises a hollow core part having an upstanding annular wall defining an enclosed inner area, and wherein the annular wall is attached to the upper side of circular body between the central aperture and the outer peripheral edge.

3. The canopy device of claim 2, wherein the annular wall has an exterior surface concentric with the outer peripheral edge, and wherein the annular wall projects upward from the upper side a sufficient distance to permit multiple loops of the cable supplying the lighting fixture with electrical power to be wrapped around the exterior surface such that a length of the cable can be changed to provide for a height adjustment of the hanging lighting fixture.

4. The canopy device of claim 1, wherein the hook bolt comprises:

a hollow elongated body having a collar of circular configuration protruding outward therefrom, and an internally threaded tubular first section projecting upward from an upper surface of the collar.

5. The canopy device of claim 4, wherein the hollow elongated body further includes:

a tapering tubular second section projecting downward from a lower surface of the collar, and an externally threaded tubular third section projecting downward from a lower end of the tapering second section, the third section having an open distal end remote from the lower end of the second section.

6. The canopy device of claim 4, wherein the hook bolt further comprises:

a cap fastener having a disk-shaped head, and a threaded shank extending from an underside of the disk-shaped head.

7. The canopy device of claim 6, wherein the threaded shank has external threads complimentary to threads of the internally threaded first section to allow the threaded shank to be received within the first section, and wherein the complimentary external threads secure the hook bolt within the central aperture of the circular body in a manner that spaces the upper surface of the collar a minimal distance from the second side of the circular body to provide free rotation of the hook bolt within the central aperture.

8. The canopy device of claim 7, wherein the minimal distance is a controlled unit of measurement of approximately 0.1 mm that permits the hook bolt to revolve within the central aperture in a generally frictionless manner.

9. The canopy device of claim 5, wherein the tubular second and third sections of the hollow elongated body include an elongated slot formed as a continuous through opening extending from an exterior surface to an interior surface of the hollow elongated body, and wherein the elongated slot extends downward from the lower surface of the collar to the open distal end of the third section to permit the cable to be inserted into the hollow elongated body.

10. The canopy device of claim 9, wherein the tubular second section includes a rounded edge bump arranged adjacent the slot configured to securely hold the cable and prevent the cable from slipping out of the slot.

11. The canopy device of claim 2, wherein the annular wall has an upper distal edge containing a through notch configured to permit the cable to be fed into the inner area of the core part.

12. The canopy device of claim 2, wherein the notched spool further comprises:

a circular base including a central access opening for permitting the cable to pass therethrough for connection to electrical wiring, a plurality of spaced apart holes to permit fasteners to pass therethrough to attach the circular base to the notched spool, and a pair of diametrically opposed mounting holes to permit additional fasteners to pass therethrough for affixing the base and notched spool to the ceiling or other elevated support structure.

13. The canopy device of claim 1, further comprising:

a bowl-shaped canopy cover configured to enclose the notched spool and hook bolt, wherein the canopy cover includes a bottom wall with a center opening and a continuous side wall extending upward from the bottom wall terminating at a top edge; and a hook bolt cap comprising a cylindrically-shaped shell having a bottom wall with a center hole and an internally threaded open passage extending from an open upper end to the bottom wall.

14. The canopy device of claim 13, wherein the hook bolt comprises a hollow, elongated body with an externally threaded lower section, wherein the lower section extends through the opening of the canopy cover after the notched spool is enclosed by the cover, and wherein threads of the internally threaded open passage engage with the threads of the externally threaded lower section, after the canopy cover encloses the notched spool, to secure the top edge of the cover against the ceiling or other elevated support structure.

15. A height-adjustable canopy device for varying the height of a lighting fixture suspended from a ceiling or other elevated support structure, the canopy device comprising:

a notched spool comprising a circular body with an outer peripheral edge, a central access opening, and a hollow core part having an upstanding annular wall attached to an upper side of the circular body between the central access opening and the outer peripheral edge, wherein:

the annular wall of the core part projects upward from the upper side of the circular body a sufficient distance to permit multiple loops of a cable supplying the lighting fixture with electrical power to be wrapped around the wall such that a length of the cable can be shortened or lengthened to adjust the height of the lighting fixture, and the outer peripheral edge has a plurality of circumferentially spaced notches to accommodate and selectively retain the cable after adjustment of the cable length; and a hook bolt extending through the central aperture and rotationally attached to the circular body.

16. The height-adjustable canopy device of claim 15, wherein the hook bolt comprises a hollow elongated body having a collar of circular configuration protruding outward therefrom, and an internally threaded tubular first section projecting upward from an upper surface of the collar.

17. The height-adjustable canopy device of claim 16, wherein the hook bolt further comprises a cap fastener having a disk-shaped head and a threaded shank extending from an underside of the disk-shaped head, and wherein the threaded shank engages threads of the treaded first section to secure the hook bolt within the central access opening in a manner permitting the hook bolt to revolve 360° about a longitudinal axis extending through the central access opening.

18. The height-adjustable canopy device of claim 16, wherein the elongated body has a tapering tubular second section projecting downward from a lower surface of the collar and an externally threaded tubular third section projecting downward from a lower end of the second section, the third section having an open distal end remote from the lower end of the second section.

19. The height-adjustable canopy device of claim 18, wherein the second section and the third section include an elongated slot formed as a continuous through opening extending from an exterior surface to an interior surface of the hollow elongated body, wherein the elongated slot extends downward from the lower surface of the collar to the open distal end of the third section to permit insertion of the cable into the hollow elongated body, and wherein the second section further includes a rounded edge bump arranged adjacent the slot to securely hold the cable from slipping out of the slot formed in the second section and the third section.

20. The height-adjustable canopy device of claim 18, further comprising:

a canopy cover configured to enclose the notched spool and hook bolt; and a hook bolt cap having an internally threaded open passage configured to be fastened to the externally threaded tubular third section of the hook bolt such that the canopy cover can be retained against the ceiling or other elevated support structure.

* * * * *